US006607835B2

(12) United States Patent
Fang et al.

(10) Patent No.: US 6,607,835 B2
(45) Date of Patent: Aug. 19, 2003

(54) COMPOSITE CONSTRUCTIONS WITH ORDERED MICROSTRUCTURE

(75) Inventors: Zhigang Fang, The Woodlands, TX (US); Anthony Griffo, The Woodlands, TX (US); Alysia C. White, Fulshear, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/881,931

(22) Filed: Jun. 15, 2001

(65) Prior Publication Data

US 2002/0020564 A1 Feb. 21, 2002

Related U.S. Application Data

(63) Continuation-in-part of application No. 09/549,974, filed on Apr. 14, 2000, now Pat. No. 6,451,442, which is a continuation of application No. 08/903,668, filed on Jul. 31, 1997, now Pat. No. 6,063,502.

(51) Int. Cl.[7] ..... B22F 3/00; C22C 1/09

(52) U.S. Cl. ..... 428/469; 428/698; 428/408; 175/425; 175/426; 175/434

(58) Field of Search ..... 428/469, 698, 428/408; 175/425, 426, 434

(56) References Cited

U.S. PATENT DOCUMENTS

| | | | | |
|---|---|---|---|---|
| 4,255,165 A | | 3/1981 | Dennis et al. | 51/309 |
| 4,378,975 A | | 4/1983 | Tomlinson et al. | 51/309 |
| 4,604,106 A | * | 8/1986 | Hall | 175/434 |
| 4,772,524 A | | 9/1988 | Coblenz | 428/699 |
| 5,271,749 A | * | 12/1993 | Rai et al. | 501/87 |
| 5,419,868 A | | 5/1995 | Honnorat | 419/4 |
| 5,492,186 A | | 2/1996 | Overstreet et al. | 175/374 |
| 5,645,781 A | | 7/1997 | Popovic' et al. | 264/639 |
| 6,063,502 A | | 5/2000 | Sue et al. | 428/469 |
| 6,290,008 B1 | * | 9/2001 | Portwood et al. | 175/420.1 |

FOREIGN PATENT DOCUMENTS

| | | |
|---|---|---|
| GB | 1572460 | 7/1980 |
| GB | 2315778 | 11/1998 |

* cited by examiner

*Primary Examiner*—Deborah Jones
*Assistant Examiner*—Jason Savage
(74) *Attorney, Agent, or Firm*—Jeffer, Mangels, Butler & Marmaro LLP

(57) ABSTRACT

Composite constructions of this invention comprise a first structural phase formed from a hard material selected from the group consisting of cermet materials, polycrystalline diamond, polycrystalline cubic boron nitride, and mixtures thereof, and a second structural phase formed from a material that is relatively softer than that used to form the first structural phase. The material selected to form the second structural phase can be the same or different from that used to form the first structural phase. The second structural phase is positioned into contact with at least a portion of the first structural phase. The composite construction includes repeated structural units that each comprise an ordered microstructure of first and second structural phases. Composite constructions of this invention are prepared by first forming a green-state part into a desired shape having the structural material phases arranged to provide the desired ordered material microstructure, and then consolidating/sintering the part using by using consolidation techniques that are capable of retaining the desired oriented or order material microstructure.

44 Claims, 4 Drawing Sheets

COMPOSITE CONSTRUCTIONS WITH ORDERED MICROSTRUCTURE

CROSS REFERENCE TO RELATED APPLICATIONS

This application is a continuation-in-part of patent application Ser. No. 09/549,974 filed on Apr. 14, 2000 which issued on Sep. 17, 2002, as U.S. Pat. No. 6,451,442, which is a continuation of patent application Ser. No. 08/903,668 filed on Jul. 31, 1997, and which issued on May 16, 2000, as U.S. Pat. No. 6,063,502.

FIELD OF THE INVENTION

This invention relates generally to composite constructions comprising two or more material phases and, more particularly, to composite constructions that are designed having an ordered microstructure of such material phases and method of making the same to provide improved properties of fracture toughness, when compared to conventional single phase cermet materials such as cemented tungsten carbide, and polycrystalline diamond, cubic boron nitride, and the like.

BACKGROUND OF THE INVENTION

Cermet materials such as cemented tungsten carbide (WC—Co) are well known for their mechanical properties of hardness, toughness and wear resistance, making them a popular material of choice for use in such industrial applications as cutting tools for machining, mining and drilling where its mechanical properties are highly desired. Cemented tungsten carbide, because of its desired properties, has been a dominant material used in such applications as cutting tool surfaces, hard facing, wear component and roller cone rock bit inserts, and cutting inserts in roller cone rock bits, and as the substrate body for drag bit shear cutters. The mechanical properties associated with cemented tungsten carbide and other cermet material, especially the unique combination of hardness, toughness and wear resistance, make this class of materials more desirable than either metal or ceramic materials alone.

For conventional cemented tungsten carbide, the mechanical property of fracture toughness is inversely proportional to hardness, and wear resistance is proportional to hardness. Although the fracture toughness of cemented tungsten carbide has been somewhat improved over the years, it is still a limiting factor in demanding industrial applications such as high penetration drilling, where cemented tungsten carbide inserts often exhibit gross brittle fracture that can lead to catastrophic failure. Traditional metallurgical methods for enhancing fracture toughness, such as grain size refinement, cobalt content optimization, and use of strengthening agents, have been substantially exhausted with respect to conventional cemented tungsten carbide.

The mechanical properties of commercial grade cemented tungsten carbide can be varied within a particular envelope by adjusting the cobalt metal content and the tungsten carbide grain sizes. For example, the Rockwell A hardness of cemented tungsten carbide can be varied from about 85 to 94, and the fracture toughness can be varied from about 8 to 19 $MPam^{-2}$. Applications of cemented tungsten carbide are limited to this envelope.

Polycrystalline diamond is another type of material that is known to have desirable properties of hardness, and wear resistance, making it especially suitable for those demanding applications described above where high wear resistance is desired. However, this material also suffers from the same problem as cemented tungsten carbide, in that it also displays properties of low fracture toughness that can result in gross brittle failure during usage.

It is, therefore, desirable that a composite construction be developed that has improved properties of fracture toughness, when compared to conventional single phase cermet materials such as cemented tungsten carbide materials, and when compared to single phase conventional materials formed from polycrystalline diamond or cubic boron nitride. It is desirable that such composite construction have such improved fracture toughness without sacrificing other desirable properties of wear resistance and hardness associated with conventional single phase cemented tungsten carbide, polycrystalline diamond, and polycrystalline cubic boron nitride materials. It is desired that such composite constructions be adapted for use in such applications as roller cone bits, hammer bits, drag bits and other mining, construction and machine applications where properties of improved fracture toughness is desired.

SUMMARY OF THE INVENTION

Composite constructions having oriented or ordered microstructures, prepared according to principles of this invention, have improved properties of fracture toughness when compared to conventional cermet materials. Composite constructions of this invention comprise a first structural phase formed from a hard material selected from the group consisting of cermet materials, polycrystalline diamond, polycrystalline cubic boron nitride, and mixtures thereof, and a second structural phase formed from a material that is relatively softer than that used to form the first structural phase.

The material selected to form the second structural phase can be the same or different from that used to form the first structural phase. The second structural phase is positioned into contact with at least a portion of the first structural phase. The composite construction includes repeated structural units that each comprise an ordered microstructure of first and second structural phases.

Composite constructions of this invention are prepared by first forming a green-state part, i.e., a preconsolidated/presintered part, into a desired shape having the structural material phases arranged to provide the desired ordered material microstructure, and then consolidating/sintering the part using by using consolidation techniques that are capable of retaining the desired oriented or order material microstructure.

Composite constructions of this invention can be used as working, wear and/or cutting surfaces in such applications as roller cone rock bits and percussion hammer bits, and shear cutters for use in such drilling applications as drag bits. Composite constructions of this invention exhibit increased fracture toughness due to the order microstructure of a substantially continuous binder structural phase disposed around the hard structural phase to increase the overall fracture toughness of the composite by blunting or deflecting the tip of a propagating crack.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

Ceramic materials generally include metal carbides, borides, suicides, diamond and cubic boron nitride (cBN). Cermet materials are materials that comprise both a ceramic material and a metal material. An example cermet material is cemented tungsten carbide (WC—Co) that is made from tungsten carbide (WC) grains and cobalt (Co). Another class of cermet materials is polycrystalline diamond (PCD) and polycrystalline cBN (PCBN) that have been synthesized by high temperature/high pressure processes. Cemented tungsten carbide is widely used in industrial applications that require a unique combination of hardness, fracture toughness, and wear resistance.

Figure 1:
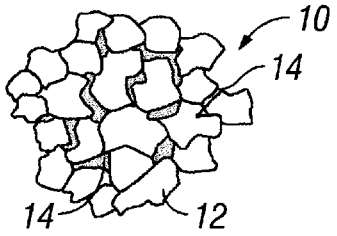
FIG. 1 (Prior Art)
FIG. 1 is a schematic photomicrograph of a portion of conventional cemented tungsten carbide.

FIG. 1 illustrates the conventional microstructure of cemented tungsten carbide 10 as comprising tungsten carbide grains 12 that are bonded to one another by the cobalt phase 14. As illustrated, the tungsten carbide grains can be bonded to other grains of tungsten carbide, thereby having a tungsten carbide/tungsten carbide interface, and/or can be bonded to the cobalt phase, thereby having a tungsten carbide/cobalt interface. The unique properties of cemented tungsten carbide result from this combination of a rigid carbide network with a tougher metal substructure. The generic microstructure of cemented tungsten carbide, a heterogeneous composite of a ceramic phase in combination with a metal phase, is similar in all cermets.

The relatively low fracture toughness of cemented tungsten carbide has proved to be a limiting factor in more demanding applications, such as inserts in roller cone rock bits, hammer bits and drag bits used for subterranean drilling and the like. It is possible to increase the toughness of the cemented tungsten carbide by increasing the amount of cobalt present in the composite. The toughness of the composite mainly comes from plastic deformation of the cobalt phase during the fracture process. Yet, the resulting hardness of the composite decreases as the amount of ductile cobalt increases. In most commonly used cemented tungsten carbide grades, cobalt is no more than about 20 percent by weight of the total composite.

As evident from FIG. 1, the cobalt phase is not continuous in the conventional cemented tungsten carbide microstructure, particularly in compositions having a low cobalt concentration. The conventional cemented tungsten carbide microstructure has a relatively uniform distribution of tungsten carbide in a cobalt matrix. Thus, a crack propagating through the composite will often travel through the less ductile tungsten carbide grains, either transgranularly through tungsten carbide/cobalt interfaces or intergranularly through tungsten carbide/tungsten carbide interfaces. As a result, cemented tungsten carbide often exhibits gross brittle fracture during more demanding applications, which may lead to catastrophic failure.

Generally, the present invention focuses on composite constructions having an oriented or ordered microstructure comprising arrangements of two or more material phases, e.g., a hard phase material and a relatively softer or binder phase material. The two material phases can be formed from different materials or can be formed from the same general type of material present in a different material proportion and/or having a different grain size to render a desired relative difference in hardness and or ductility.

It is to be understood that the terms "oriented" and "ordered" can be used interchangeably to described the predetermined manner in which the structural phases making up the composite construction material microstructure are arranged. In each case, the structural phases are ordered in the sense that they are arranged or combined together in a predetermined, rather than a random, fashion. In some cases the ordered arrangement of the structural phases can also be oriented relative to say an axis or other reference point of the microstructure.

In an example embodiment, the hard phase can be formed from cermet materials, PCD, PCBN and the like, and relatively softer phase can be formed from a different material such as metals, metal alloys, and in some instances cermet materials. In another example embodiment, the hard phase can be formed from cermet materials, PCD, PCBN and the like, and the relatively softer phase can be formed from the generally same type of material having different material proportions and/or grain sizes to make it relatively softer and/or more ductile than the hard phase material. For example, the relatively softer phase can be formed from the same type of material as that used to form the hard phase, only having a larger proportion of a metal or metal alloy constituent. Composite constructions with ordered microstructures of this invention generally comprise a continuous phase of the relatively softer material that is disposed around the relatively harder phase material of the composite to maximize the ductile effect of the relatively softer binder phase material.

The term "binder phase" as used herein refers to the material phase that surrounds the relatively harder hard phase material. Conversely, the term "hard" phase material as used herein refers to the material phase that is surrounded by the relatively softer binder phase material. Depending on the particular invention application, the material phases forming the microstructure can take on different geometric forms, e.g., the binder phase material can be in the form of a shell that surrounds a core of the hard phase material, or can be in the form of a sheet that is coiled around a sheet of the hard phase material. It is to be understood that the specific shapes and/or manner in which the microstructure material phases are arranged will vary depending on the particular composite construction application and the physical properties needed for the microstructure to meet the demands of such application.

As mentioned above, the fracture toughness of conventional cemented tungsten carbide or other cermets is controlled by its ductile metal binder (e.g., cobalt). Plastic deformation of the binder phase during the crack propagation process accounts for more than 90 percent of the fracture energy. Composite constructions of this invention are designed having a maximum fracture path through the binder phase, thereby improving the ability of the composite to blunt or deflect the tip of a propagating crack. For example, roller cone rock bit inserts that are manufactured from composite constructions of this invention having ordered microstructures, i.e., having the composite construction disposed along an insert working surface, are known to display increased fracture toughness, resulting in extended service life.

Figure 2:
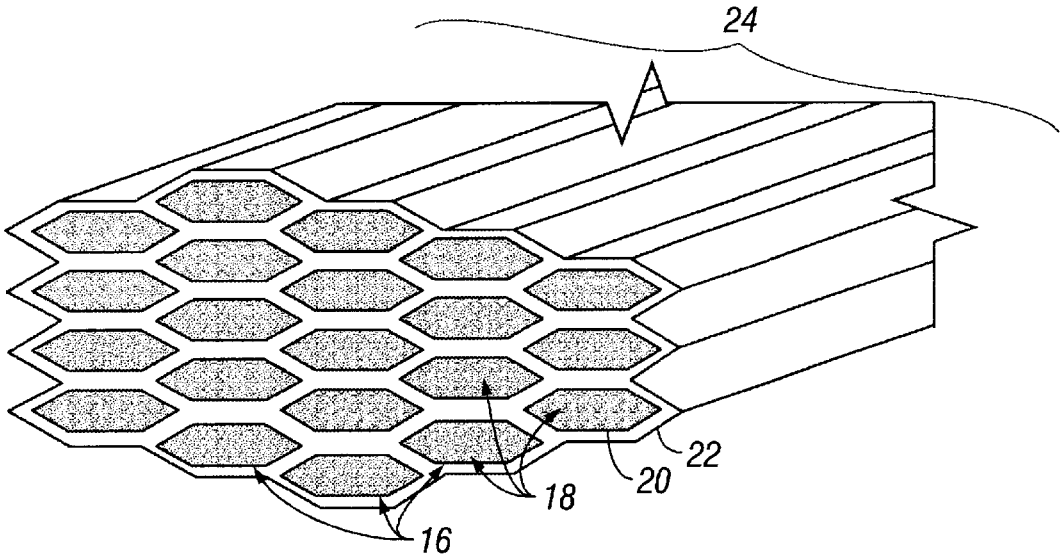
FIG. 2 is a perspective cross-sectional side view of a first embodiment composite construction of this invention.

As discussed briefly above, the structural arrangement of the hard phase material and the binder phase in composite constructions of the invention may take different specific forms. Referring to FIG. 2, a first example embodiment composite construction 16 of this invention comprises a plurality of bundled together cylindrical cased or coated fibers 18. Each fiber 18 comprises a core 20 formed from the hard phase material. Each core 20 is surrounded by a shell or casing 22 formed from the binder phase material. The shell or casing can be applied to each respective core by the method described in U.S. Pat. No. 4,772,524, which is incorporated herein by reference, or by other well known spray or coating processes. Additionally, "Flaw Tolerant, Fracture Resistant, Non-Brittle Materials Produced Via Conventional Powder Processing," (*Materials Technology,* Volume 10 1995, pp. 131–149), which is also incorporated herein by reference, describes an extrusion method for producing such coated fibers 18.

The plurality of coated fibers 18 are oriented parallel to a common axis and are bundled together and extruded into a rod 24, which comprises a cellular composite construction made up of binder phase material with hard phase material cores. Typically, before extrusion, the loose fibers 18 in the bundles are round in transverse cross section. After extrusion the fibers 18 are squashed together and have a generally hexagonal cross section. The fibers may be deformed into other shapes locally where the fibers are not parallel to each other in the bundle or are not aligned to yield the regular hexagonal pattern illustrated. The fibers 18 are bonded together by heating to form an integral mass.

In an example first embodiment, the composite construction is produced from a plurality of coated fibers 18 having a core 20 of tungsten carbide and cobalt powder (as the hard phase material) surrounded by a shell 22 of cobalt metal (as the ductile phase). A green-state product having an ordered microstructure is first produced in the following manner. The fibers are fabricated from a mixture of powdered WC—Co, powdered Co, and thermoplastic binder such as wax by the extrusion process identified above. The binder may be as much as 50 percent by volume of the total mixture. Tungsten carbide powder and cobalt powder are available in micron or submicron sizes, although it is desired that the tungsten carbide powder have a particle size of less than about 20 micrometers. A plurality of these cobalt cased WC—Co fibers 18 are bundled together and extruded to form a fibrous WC—Co composite construction. The extruded rod 24 is the green-state product having an ordered microstructure, which can be cut to a desired geometry of the finished part, for example a cylinder with an approximately conical end for forming an insert for a rock bit, or sliced to form a cutting surface for placement onto a cutting substrate for forming a cutting surface.

The green-state product is then dewaxed by heating in a vacuum or protective atmosphere to remove the thermoplastic binder. The dewaxed green-state product, having retained its ordered microstructure, is further heated to an elevated temperature near the melting point of cobalt, to form a solid, essentially void-free integral composite construction having the desired ordered microstructure. The regions defined by the fibers 18 have a WC—Co core 20 thickness in the range of from about 30 to 300 micrometers, surrounded by a shell 22 of cobalt having a thickness in the range of from about 3 to 30 micrometers.

Although use of a cemented tungsten carbide material and cobalt have been described above as example respective hard phase and binder phase materials, it is to be understood that composite constructions of this invention may be formed from many other different materials that are discussed in detail below. For example, composite constructions of this invention can comprise a hard phase formed from PCD or PCBN, and a relatively softer phase formed from a different material such cemented tungsten carbide or cobalt metal. In an example first embodiment, the core 20 can be formed from a PCD or PCBN composition according to the process described in U.S. Pat. Nos. 4,604,106; 4,694,918; 5,441,817; and 5,271,749 that are each incorporated herein by reference, starting with diamond or cBN powder and wax. Each PCD core 20 is surrounded by a cobalt metal shell 22 to form the fiber 18, and a plurality of the fibers 18 are bundled together and extruded to form a fibrous PCD-cobalt composite construction. The regions defined by the fibers 20 have a PCD core 20 thickness in the range of from about 30 to 300 micrometers, surrounded by a shell 22 of cobalt having a thickness in the range of from about 3 to 30 micrometers.

Figure 3:
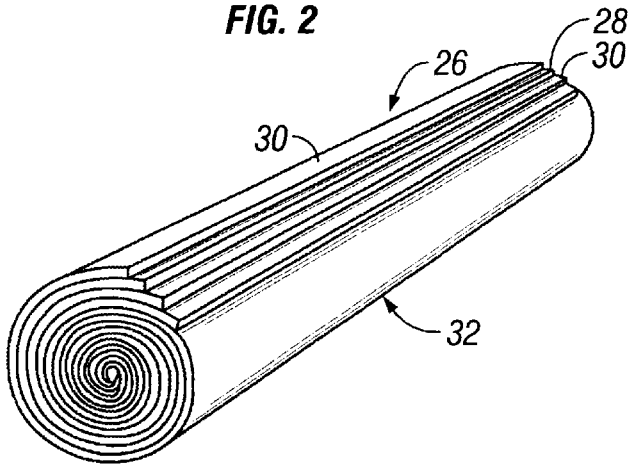
FIG. 3 is a perspective side view of a second embodiment composite construction of this invention.

Referring to FIG. 3, a second example embodiment composite construction 26, prepared according to principles of the invention, comprises a repeating arrangement of monolithic sheets 28 of a hard phase material, and sheets 30 of a binder phase that are arranged to produce a swirled or coiled composite construction.

In an example second composite construction embodiment, the green-state product having an ordered microstructure comprises sheets 28 that are formed from a powder cermet material, and sheets 30 are formed from a powder metal. A thermoplastic binder is added to both powder sheets 28 and 30 for cohesion and to improve the adhesion between the adjacent sheets. The sheets 28 of the hard phase material and the sheets 30 of the binder phase are alternately stacked on top of one another and coiled into a rod 32 having a spiral cross section. Additionally, depending on the desired composite construction properties for a particular application, the sheets 28 and 30 may be formed from more than one type of hard phase material and/or more than one type of binder phase material, and can be stacked in random fashion, to form the second embodiment composite rod 32 of this invention.

In an example second composite embodiment, the sheets 28 are formed from powdered WC—Co, and the sheets 30 are formed from powdered cobalt. Alternatively, the sheets 28 can be formed from PCD or PCBN, and the sheets 30 can be formed from a relatively more ductile binder material such as metals, metal alloys, cermets and the like. The WC—Co sheets 28 are formed having a thickness in the range of from about 50 to 300 micrometers, and the cobalt sheets 30 are formed having a thickness in the range of from about 5 to 10 micrometers after consolidation. The green-state product is dewaxed at elevated temperature, and is consolidated by a solid-state consolidation method to provide a final product having the desired retained ordered microstructure of the green-state product.

Figure 4:
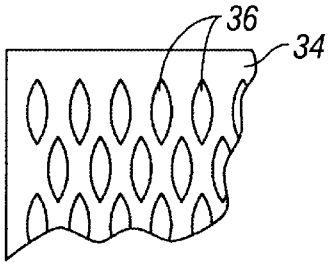
FIG. 4 is an elevational view of a third embodiment composite construction of this invention.

In a third composite construction embodiment having an ordered microstructure, sheets 34 in the form of expanded metal sheets, shown in FIG. 4, may be used in place of the sheets 30 to form the coiled composite rod of FIG. 3. One method for creating such expanded metal sheet 34 is to form a plurality of parallel slits 36 in a metal sheet, and stretch the metal sheet in a direction perpendicular to the slits to cause the slits to expand. Properties of the finally-formed composite can be controlled by stacking alternate sheets of expanded sheet 34 and non-expanded sheet 30, or by varying the spacing of the slits 36. The stacked sheets can be rolled or pressed to minimize void volume of the expanded sheet, or they may be coiled to form a tight roll and swaged or drawn to reduce void volume.

Figure 5:
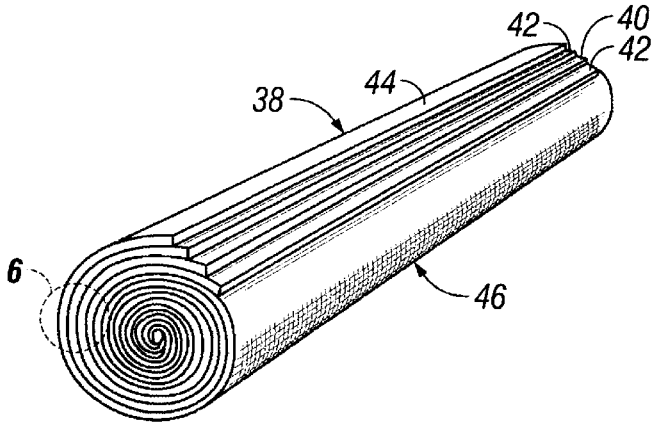
FIG. 5 is a perspective side view of a fourth embodiment composite construction of this invention.
Figure 6:
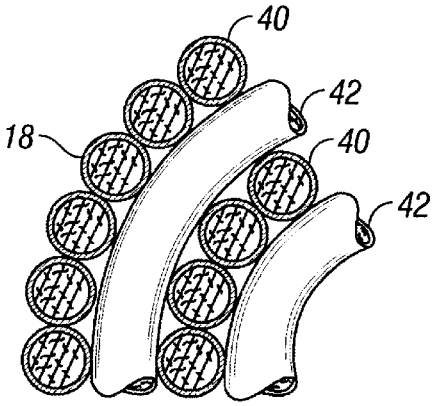
"FIG. 6 is an enlarged view of the fourth embodiment composite construction of section 6 in FIG. 5."

Referring to FIG. 5, in a fourth embodiment composite construction 38 having an ordered microstructure, coated fibers 18 (as shown in FIGS. 1 and 6) that are constructed the same as described above for the first embodiment are used to form a plurality of sheets 40, 42 and 44 that are arranged to produce a coiled fibrous composite. The fibers 18 may be oriented or arranged in any manner desired to form the sheets, depending on the desired composite properties for a particular application. For example, the fibers 18 within each sheet may be oriented parallel to one another, as in sheets 40 and 42 (as illustrated in FIG. 6), or the fibers 18 in each sheet may be interwoven as in sheet 44 (as best shown in FIG. 5). Sheets 40, 42 and 44 are stacked on top of one another and coiled into a fibrous composite rod 46. Preferably, the sheets are stacked in such a manner that adjacent sheets have different fiber orientations. An exemplary cross section of such a rod 46 is illustrated in FIG. 6.

Composite construction green-state products, when formed in the shape of a rod, are extruded or swaged to the diameter for example of roller cone rock bit insert blanks, and cut to form a plurality of insert blanks. The blanks may be machined to form the ends, i.e., working surface, of rock bit inserts, or conventional pressing methods may be used to form the blanks into rock bit inserts. The green-state products are consolidated using solid-state consolidation techniques to provide a sintered composite construction having the desired retained oriented or ordered microstructure.

Figure 7:
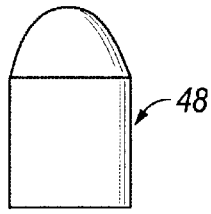
FIG. 7 is a perspective side view of an insert for use in a roller cone or a hammer drill bit formed from a composite construction of this invention.

Referring to FIG. 7, an insert 48 for use in a wear or cutting application in a roller cone drill bit or percussion or hammer drill bit may be formed from composite constructions having oriented microstructures of this invention. For example, such inserts can be formed from blanks that are made from fourth embodiment composite constructions of this invention, and that are pressed or machined to the desired shape of a roller cone rock bit insert. The shaped inserts are then heated to about 200 to 400° C. in vacuum or flowing inert gas to debind the composite, and the inserts are then sintered at an elevated temperature below the melting point of the binder phase material, in this case below the melting temperature of cobalt.

A key feature of composite constructions of this invention is presence of ordered or controlled material phases, thereby providing the desired oriented microstructure. In order to ensure the production of such final product it is essential that the oriented or ordered arrangement of material phase be retained during the process of making the composite construction. Thus, composite constructions of this invention are made by first constructing a green-state product having the desired arrangement of material phases, and then consolidating an sintering the green-state product in a manner that does not permit appreciable migration between the material phases, thereby retaining the desired oriented microstructure.

Solid-state consolidation techniques useful for forming composite constructions of this invention include hot pressing, hot isostatic pressing (HIPing) as described in U.S. Pat. No. 5,290,507 that is incorporated herein by reference, and rapid omnidirectional compaction (ROC) as described in U.S. Pat. Nos. 4,945,073; 4,744,943; 4,656,002; 4,428,906; 4,341,577 and 4,124,888 which are each incorporated herein by reference.

Broadly speaking, the ROC process involves forming a mixture from the desired precursor materials, e.g., WC hard grains and a ductile metal binder in the event that the desired final material is a cemented tungsten carbide, along with a temporary wax binder. The mixture is pressed in a closed die to a desired shape, such as a rock bit insert or a cap the forms a working surface of a rock bit insert. The resulting "green" insert is vacuum dewaxed and presintered at a relatively low temperature to achieve a density appreciably below full theoretical density. The presintering is only sufficient to permit handling of the insert for subsequent processing. The green insert is wrapped in a first container and is then placed in second container made of a high temperature high pressure self-sealing ceramic material. The second container is filled with a special glass powder and the green part disposed within the first container is embedded in the glass powder. The glass powder has a lower melting point than that of the green part, or of the ceramic die.

The second container is placed in a furnace to raise it to the desired consolidation temperature, that is also above the melting point of the glass. For example, for a WC—Co hard phase pellet-cobalt ductile metal phase system, the consolidation temperature is in the range of from 1,000° C. to 1,280° C. The heated second container with the molten glass and green part immersed inside is placed in a hydraulic press having a closed cylindrical die and a ram that presses into the die. Molten glass and the green part are subjected to high pressure in the sealed ceramic container. The part is isostatically pressed by the liquid glass to pressure as high as 120 ksi. The temperature capability of the entire process can be as high as 1,800° C. The high pressure is applied for a short period of time, e.g., less than about five minutes and preferably one to two minutes, and isostatically compacts the green part to essentially 100 percent density.

Conventional liquid phase consolidation techniques are generally not thought to be useful for forming composite constructions of this invention because of the tendency for the binder material to migrate, thereby causing the material phases to become distorted or unoriented. However, liquid phase consolidation techniques may be used that operate under conditions of reduced temperature. For example, reactive liquid phase sintering relates to a process whereby one or more of the constituent elements is capable of releasing energy upon formation (i.e., enthalpy formation is high). This energy is released as heat which can (if conditions are proper) produce a self-propagating reaction that will consolidate the component at low temperature (that being the temperature needed to initiate the reaction). Thus, order composite constructions of this invention can be using this technique if one of the material phases contains an element that, upon reaching an ignition temperature, will operate to densify the entire component. This technique is nonreversible, meaning that the reaction product will not go to liquid due to an increased melting point of the compound in comparison to its constituent elements.

Supersolidus liquid phase sintering is another technique, that can be used to consolidate composite constructions of this invention, whereby a composition will yield upon heating a mixture of liquid and solid phases. This combination has the advantage over conventional liquid phase sintering of allowing for densification at lower temperatures and improved distortion control since the operating temperature dictates the yield of the liquid. Hence a composition can be contrived where one phase develops supersolidus liquid phase sintering conditions and infiltrate another phase, thereby causing the entire structure to densify. Alternatively, each of the material phases forming the composite construction can have materials capable of supersolidus liquid phase sintering.

Other solid-state consolidation techniques useful for making order composite constructions of the invention include those incorporating a rapid heating step such as microwave sintering, plasma-activated sintering, and other types of field-assisted sintering. Each of these techniques are effective at producing a final composite construction having the retained oriented or ordered microstructure.

Examples of consolidation techniques using rapid heating methods include field-assisted sintering and laser heating. Field-assisted sintering used an electromagnetic field to generate rapid heating and improves surface transport. Often, energy is concentrated on surface asperities. Several heating techniques for conducting field-assisted sintering exist, including but not limited to induction heating, microwave, plasma and electric discharge. Induction sintering uses alternating current to create a magnetic field with tie material to induce eddy currents. These eddy currents serve to rapidly heat a component. Similarly, microwave sintering allows for rapid heating of a component based on its (or susceptor) material properties. A susceptor is a material that will do the heating in either induction or microwave when the compact is either nonconductive or transparent to microwave. Besides rapid heating, microwave sintering is believed to lower activation energies for diffusion and promote steep concentration gradients (further increasing diffusivity). Microwave sintering or microwave-assisted sintering are consolidation techniques, typically at ambient pressure, which enhances densification because of rapid heating and homogenization of the part's internal temperature and creation of plasma at all powder asperities to create an enhanced surface.

Laser heating is an approach that can be used to primarily sinter a thin section of powder (wherein the depth of penetration is very limited) and, hence, is often used for rapid prototyping machines that build layer by layer.

Electrical discharge heating is used to heat a component via electrical resistance. Typically, a hot press is employed since constant contact (pressure) is needed and graphite adds in the electrical conduction/heating of a component. When the electric filed is pulsed, plasma is generated therefrom at the asperities. Likewise, plasma sintering is similar in that an electromagnetic field is generated resulting in an enhanced diffusion. A secondary type of plasma sintering is to induce an external plasma using RF heating of gaseous species to promote localized heating and concentration gradients. However, this system is not as advantageous as the system described below due to the lack of applied pressure.

Plasma-assisted sintering is a technique whereby plasma is generated within the powder compact. This plasma enhances surface activated diffusion, which promotes densification at lower sintering temperatures and/or promotes shorter sintering times. The instantaneous electric pulses using high currents generate the plasma. Often the plasma-assisted sintering is operated effectively applied to hot pressing, where the electric field pulses are deliver to the compact axially through the use of graphite compaction rods. This technique is also referred to as field-assisted sintering. Field strengths vary for different materials, but generally range in from 18 to 50 V/cm.

Composite constructions having oriented or ordered microstructures, prepared according to principles of this invention, exhibit a higher fracture toughness than conventional cermet materials such as cemented tungsten carbide, due to the ordered arrangement of the hard phase material disposed within a continuous, or substantially continuous binder phase making up the material microstructure of the composite. Configured in this manner, the binder phase disposed around the lower toughness hard metal phase operates to increase the overall fracture toughness of the composite by blunting or deflecting the front of a propagating crack.

Materials useful for forming the hard phase in composite constructions of this invention can be selected from the group of cermet materials including, but not limited to, carbides, borides and nitrides of the group IVB, VB, VIB, VIIB, and VIII metals and metal alloys of the periodic table (CAS version). Example cermet materials include: WC—M, TiC—M, TaC—M, VC—M, and $Cr_3C_2$—M, where M is a metal such as Co, Ni, Fe, or alloys thereof as described above. A preferred cermet material is WC—Co. Additionally, the hard phase material include PCD, PCBN, and mixtures of PCD and PCBN with carbides, borides and nitrides of the group IVB, VB, VIB, VIIB, and VIII metals and metal alloys of the periodic table CAS version). Composite constructions of this invention comprising PCD as the hard phase material are highly desirable because they are known to increase the fracture toughness of PCD by as much as two fold.

Materials useful for forming the relatively softer or binder phase in composite constructions of this invention can be selected from the same types of materials disclosed above for forming the hard phase, or can be selected from different materials. In the event that the selected relatively softer or binder phase material is the same as that forming the hard phase material, it is desired that the proportion and/or the grain size of the selected binder phase material be adjusted so that it be relatively softer or more ductile than the hard phase material. For example, when both the hard and soft phase materials are selected to be WC—Co, it is desired that the soft phase WC—Co have a higher proportion of cobalt than the hard phase WC—Co, and/or the soft phase WC—Co have a WC grain size that is smaller than that of the hard phase WC—Co to provide a material phase that is relatively softer or more ductile than the hard phase material. Accordingly, it is to be understood that composite constructions of this invention can be configured having an oriented microstructure of two or more material phases formed from the same general type of material.

The relatively softer phase can also be formed from a material that is different than that used to form the hard phase material. Accordingly, materials useful for forming the relatively softer phase include those selected from the group IIIA, IVB, VB, VIB, VIIB, and VIII metals and metal alloys of the periodic table (CAS version), such as Fe, Ni, Co, Cu, Ti, Al, Ta, Mo, Nb, W, and their alloys. Additionally, the binder phase can be formed from the group including carbides, borides and nitrides of the group IVB, VB, VIB, VIIB, and VIII metals and metal alloys of the periodic table (CAS version), when the hard phase material (e.g., the fiber core) is PCD or PCBN because of their properties of good thermal expansion compatibility and good toughness. For example, the binder phase can be WC—Co when the hard phase material is PCD or PCBN. In an example embodiment, a desired binder phase is cobalt when the hard phase material is WC—Co.

In order to enhance the fracture toughness of composite constructions of this invention, it is desired that the binder phase both surround each hard phase, and have a thickness between the plurality of hard phases that is greater than the mean free path between the hard grains forming each hard phase. For example, in the event that the hard phase material is formed from WC—Co, it is desired that the binder phase surrounding each hard phase have a thickness between the hard phases of greater than the mean free path of the WC grains in each hard phase.

The volume fraction of the continuous binder phase in the composite construction will influence the properties of the overall composite, including fracture toughness. The volume fraction of the binder phase may be in the range of from about 15 to 50 percent by volume, based on the total volume of the composite. Preferably, for composite constructions designed for use in more demanding applications, the binder phase can be in the range of from about 15 to 30 percent by volume of the total volume of the composite.

Composite constructions having oriented microstructures, prepared according to principles of this invention, will be better understood and appreciated with reference to the following examples:

Example No. 1

Fiber Composite Construction (WC—Co Core)

A fiber composite construction included a hard phase material core formed from WC—Co that was made from WC powder and Co powder, having an average grain size in the range of from about one to six micrometers. The WC—Co contained greater than about six percent by weight Co, based on the total weight of the WC—Co. The binder phase fiber shell was formed from Co, but alternatively could be formed from any of the above-identified metals or metal alloys. Each fiber had a diameter in the range of from 30 to 300 micrometers after consolidation.

Example No. 2

Fiber Composite Construction (PCD Core)

A fiber composite construction included a core formed from PCD according to techniques described in U.S. Pat. Nos. 4,604,106; 4,694,918; 5,441,817; and 5,271,749. Diamond powder was used having an average grain size in the range of from about 4 to 100 micrometers, and was mixed with wax according to the referenced process, and was sintered to form the PCD. The binder phase fiber shell was formed from 411 carbide (i.e., WC comprising 11 percent by weight cobalt and having a WC grain size of approximately four micrometers). Alternatively, the fiber shell could be formed from any of the above-identified metals, metal alloys, and cermets. Each fiber had a diameter in the range of from 30 to 300 micrometers after consolidation.

Example No. 3

Fiber Composite Construction (PCBN Core)

A fiber composite construction included a core formed from PCBN and WC—Co. The WC—Co was made from WC powder and Co powder having an average grain size in the range of from about one to six micrometers, and the PCBN was in the form of cBN powder having an average grain size in the range of from about 40 to 100 micrometers. The WC—Co contained greater than about six percent by weight Co, based on the total weight of the WC—Co. The core comprised in the range of from about 50 to 95 percent by volume PCBN based on the total volume of the core. Alternatively, the core can be formed from PCBN and TiC, or cBN and TiN+Al, or cBN and TiN+$Co_2Al_9$, where the core comprises in the range of from about two to ten percent by weight Al or $Co_2Al_9$ based on the total weight of the core.

The binder phase fiber shell was formed from WC—Co, made in the same manner described above for the core. Alternatively, the fiber shell could be formed from any of the above-identified metals, metal alloys or cermet materials. Each fiber had a diameter in the range of from 30 to 300 micrometers.

Example Nos. 4 to 6

Bundled Fiber Composite Construction

Bundles were formed in the manner described above from the fiber composite constructions of Example Nos. 1 to 3 for the application of a roller cone rock bit insert. Example No. 4 bundle was formed by combining the fibers of Example Nos. 1 and 2 together. Example No. 5 bundle was formed by combining the fibers of Example Nos. 2 and 3 together. Example No. 6 bundle was formed by combining the fibers of Example Nos. 1, 2 and 3 together.

Example No. 7

Hard Phase Material Sheet (WC—Co Sheet)

A hard phase sheet comprising WC—Co was made from WC powder and Co powder having an average grain size in the range of from about one to six micrometers. The WC—Co contained greater than about six percent by weight Co, based on the total weight of the WC—Co. The sheet had a thickness in the range of from about 30 to 300 micrometers after consolidation.

Example No. 8

Hard Phase Material Sheet (PCD Sheet)

A hard phase sheet comprising PCD was prepared according to the technique described in the above-identified U.S. Patent, starting with diamond powder having an average particle size in the range of from about 4 to 100 micrometers. The sheet had a thickness in the range of from about 30 to 300 micrometers after consolidation.

Example No. 8

Hard Phase Material Sheet (PCBN Sheet)

A hard phase material sheet comprising PCBN and WC—Co was made from WC powder and Co powder having an average grain size in the range of from about one to six micrometers, and the cBN was in the form of powder having an average grain size in the range of from about 4 to 100 micrometers. The WC—Co contained greater than about six percent by weight Co, based on the total weight of the WC—Co. The sheet had a thickness in the range of from about 30 to 300 micrometers after consolidation.

Example No. 9

Binder Phase Sheet

A binder phase sheet was made from Co. Alternatively, the sheet could have been made from any one of the above-identified metals or metal alloys. The sheet had a thickness in the range of from about 3 to 30 micrometers after consolidation.

Example Nos. 10 to 13

Spiral Composite Constructions

Spiral composite constructions for use as tapes were prepared by combining alternating sheets of Example Nos. 6 to 9. Example No. 10 spiral composite was formed by combining alternate sheets of Example Nos. 6 and 7 together, or alternatively combining alternating sheets of Example No. 7 with the sheets of Example No. 9. Example No. 11 spiral composite was formed by combining alternate sheets of Example Nos. 6 and 8 together, or alternatively combining alternating sheets of Example No. 8 with the sheets of Example No. 9. Example No. 12 spiral composite was formed by combining alternate sheets of Example Nos. 6, 7 and 8 together, or alternatively combining alternating sheets of Example Nos. 7 and 8 with the sheets of Example No. 9.

Example No. 14

Expanded Composite Construction Sheet (PCD)

An expended sheet comprising PCD and WC—Co was made from WC powder and Co powder having an average grain size in the range of from about one to six micrometers, and the PCD was in the form of powder having an average grain size in the range of from about 4 to 100 micrometers. The WC—Co contained greater than about six percent by weight Co, based on the total weight of the WC—Co. The expanded sheet had a thickness in the range of from about 30 to 300 micrometers after consolidation.

Example No. 15

Expanded Composite Construction Sheet (PCBN)

An expended sheet comprising cBN, WC—Co, TiC and Al was made from WC powder and Co powder having an average grain size in the range of from about one to six micrometers, and the PCBN was in the form of cBN powder having an average grain size in the range of from about 4 to 100 micrometers. The WC—Co contained greater than about six percent by weight Co, based on the total weight of the WC—Co. The expanded sheet had a thickness in the range of from about 30 to 300 micrometers after consolidation.

Example Nos. 16 to 18

Spiral Composites Constructions Comprising Expanded Sheets

Spiral composite constructions were prepared by combining alternating expanded sheets of Example Nos. 14 and 15 with the sheets of Example Nos. 6 to 9. Example No. 16 spiral composite was formed by combining alternate expanded sheets of Example No. 14 with the sheets of Example No. 6, or alternatively combining alternating expanded sheets of Example No. 14 with the sheets of Example No. 9. Example No. 17 spiral composite was formed by combining alternate expanded sheets of Example No. 15 with the sheets of Example No. 6, or alternatively combining alternating expanded sheets of Example No. 14 with the sheets of Example No. 9. Example No. 18 spiral composite was formed by combining alternate expanded sheets of Example No. 14 with the sheets of Example No. 6, and the expanded sheets of Example No. 15, or alternatively combining alternating expanded sheets of Example No. 14 with the sheets of Example No. 9, and the expanded sheets of Example No. 15.

Composite constructions having oriented microstructures of this invention can be used in a number of different applications, such as tools for mining, machining and construction applications, where the combined mechanical properties of high fracture toughness, wear resistance, and hardness are highly desired. Composite constructions of this invention can be used to form working, wear and/or cutting components in machine tools and drill and mining bits such as roller cone rock bits, percussion or hammer bits, diamond bits, and substrates for shear cutters.

Figure 8:
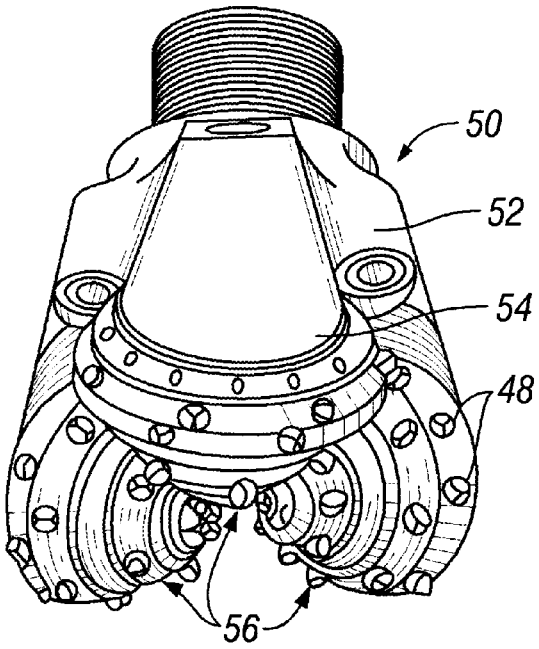
FIG. 8 is a perspective side view of a roller cone drill bit comprising a number of the inserts of FIG. 7.

For example, referring to FIG. 8, wear or cutting inserts 48 (shown in FIG. 7) formed from composite constructions of this invention can be used with a roller cone rock bit 50 comprising a body 52 having three legs 54, and a roller cutter cone 56 mounted on a lower end of each leg. The inserts 48 can be fabricated according to one of the methods described above. The inserts 48 are provided in the surfaces of the cutter cone 56 for bearing on a rock formation being drilled.

Figure 9:
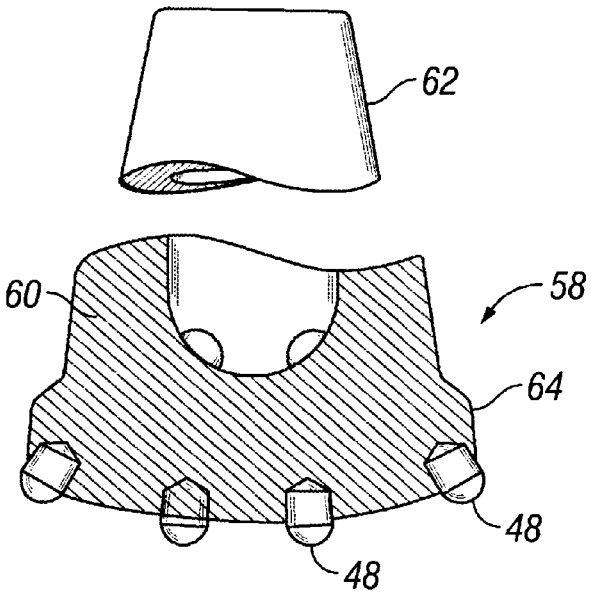
FIG. 9 is a perspective side view of a percussion or hammer bit comprising a number of inserts of FIG. 7.

Referring to FIG. 9, inserts 48 formed from composite constructions of this invention can also be used with a percussion or hammer bit 58, comprising a hollow steel body 60 having a threaded pin 62 on an end of the body for assembling the bit onto a drill string (not shown) for drilling oil wells and the like. A plurality of the inserts 48 are provided in the surface of a head 64 of the body 60 for bearing on the subterranean formation being drilled.

Figure 10:
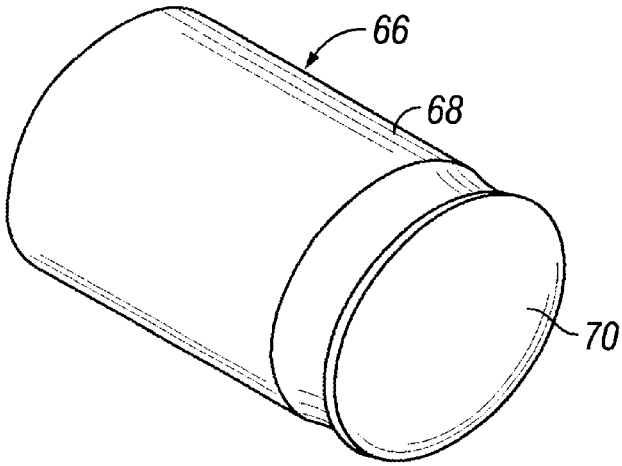
FIG. 10 is a schematic perspective side view of a polycrystalline diamond shear cutter comprising a substrate and/or cutting surface formed a composite construction of this invention.

Referring to FIG. 10, composite constructions of this invention can also be used to form PCD shear cutters 66 that are used, for example, with a drag bit for drilling subterranean formations. More specifically, composite constructions of this invention can be used to form a shear cutter substrate 68 that is used to carry a layer of PCD 70 that is sintered thereto or, alternatively, the entire substrate and cutting surface can be made from the composite construction.

Figure 11:
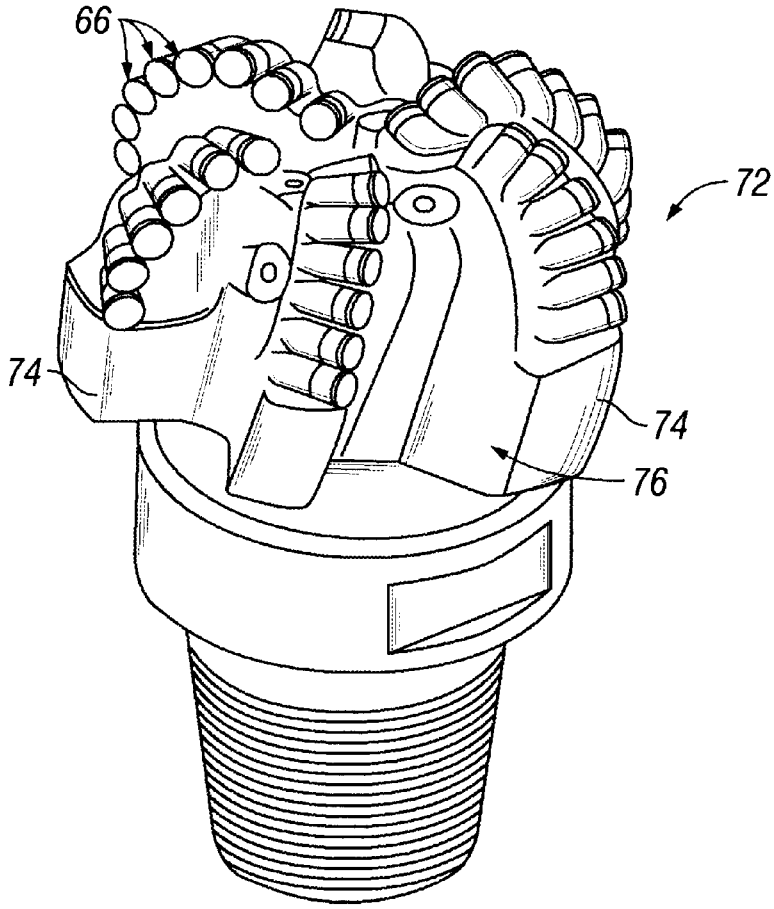
FIG. 11 is a perspective side view of a drag bit comprising a number of the shear cutters of FIG. 10

Referring to FIG. 11, a drag bit 72 comprises a plurality of such PCD shear cutters 66 that are each attached to blades 74 that extend from a head 76 of the drag bit for cutting against the subterranean formation being drilled.

Although, limited embodiments of composite constructions having oriented microstructures, methods of making the same, and applications for the same, have been described and illustrated herein, many modifications and variations will be apparent to those skilled in the art. For example, although composite constructions have been described and illustrated for use with rock bits, hammer bits and drag bits, it is to be understood that composites constructions of this invention are intended to be used with other types of mining and construction tools. Accordingly, it is to be understood that within the scope of the appended claims, composite constructions according to principles of this invention may be embodied other than as specifically described herein.

What is claimed is:

1. A composite construction comprising:

a first structural phase comprising a hard material selected from the group consisting of cermet materials, polycrystalline diamond, polycrystalline cubic boron nitride, and mixtures thereof; and a second structural phase formed from hard material selected from the group consisting of cermet materials, polycrystalline diamond, polycrystalline cubic boron nitride, and mixtures thereof, the second structural phase being relatively softer than the first structural phase, and the second structural phase being in contact with at least a portion of the first structural phase;

wherein the composite construction has a material microstructure that includes repeated structural units comprising an ordered arrangement of first and second structural phases; and wherein the repeated structural units are disposed across a working surface of the composite construction.

2. The composite construction as recited in claim 1 wherein the repeated structural units comprises a number of first structural phases that are separated from one another by a substantially continuous second structural phase.

3. The composite construction as recited in claim 1 wherein the first and second structural phases are each formed from a cermet material selected from the group of carbides, borides and nitrides of the group IVB, VB, VIB, VIIB, and VIII metals and metal alloys of the periodic table.

4. The composite construction as recited in claim 3 wherein the first and second structural phases are each formed from cemented tungsten carbide.

5. The composite construction as recited in claim 3 wherein the cermet material used to form the second structural phase has a higher proportion of metal constituent than the cermet material used to form the first structural phase.

6. The composite construction as recited in claim 3 wherein the cermet material used to form the second structural phase comprises hard grains that are smaller in size than hard grains in the cermet material used to form the first structural phase.

7. The composite construction as recited in claim 1 wherein the first and second structural phases are each formed from polycrystalline diamond.

8. The composite construction as recited in claim 7 wherein both the first and second structural phases include a metal constituent, and wherein the second structural phase comprises a larger proportion of the metal constituent than the first structural phase.

9. A rotary cone rock bit comprising a bit body including at least one journal pin extending from a leg of the bit, a cutter cone rotatably mounted on the journal pin, and an insert disposed along a surface of the cutter cone, the insert comprising the composite construction of claim 1.

10. A composite construction comprising:

a first structural phase comprising a hard material selected from the group consisting of cermet materials, polycrystalline diamond, and mixtures thereof; and a second structural phase formed from hard material selected from the group consisting of cermet materials, polycrystalline diamond, polycrystalline cubic boron nitride, and mixtures thereof, the second structural phase being relatively more ductile than the first structural phase to control crack propagation through the composite construction by plastically deforming, the second structural phase being in contact with at least a portion of the first structural phase;

wherein the composite construction has a material microstructure that includes repeated structural units comprising an ordered arrangement of two or more first structural phases that are each separated from one another by a substantially continuous second structural phase.

11. The composite construction as recited in claim 10 wherein the first and second structural phases are each formed from a cermet material selected from the group of carbides, borides and nitrides of the group IVB, VB, VIB, VIIB, and VIII metals and metal alloys of the periodic table.

12. The composite construction as recited in claim 10 wherein the first and second structural phases are each formed from cemented tungsten carbide.

13. The composite construction as recited in claim 12 wherein the cermet material used to form the second structural phase has a higher proportion of metal constituent than the cermet material used to form the first structural phase.

14. The composite construction as recited in claim 12 wherein the cermet material used to form the second structural phase comprises hard grain constituents that are smaller in size than hard grain constituents in the cermet material used to form the first structural phase.

15. The composite construction as recited in claim 10 wherein the first and second structural phases are each formed from polycrystalline diamond.

16. The composite construction as recited in claim 15 wherein both the first and second structural phases include a metal constituent, and wherein the second structural phase comprises a larger proportion of the metal constituent than the first structural phase.

17. A rock bit insert comprising the composite construction of claim 10 disposed across a working insert surface.

18. A rotary cone rock bit comprising:

a bit body including at least one journal pin extending from a leg portion of the bit;

a cutter cone rotatably mounted on the journal pin; and an insert disposed along a surface of the cutter cone, the insert comprising a composite construction positioned along a working surface of the insert, the composite construction having an ordered microstructure of repeating structural units, each structural unit comprising:

a first structural phase comprising a hard material selected from the group consisting of cermet materials, polycrystalline diamond, and mixtures thereof; and a second structural phase comprising hard material selected from the group consisting of cermet materials, polycrystalline diamond, polycrystalline cubic boron nitride, and mixtures thereof, the second structural phase being relatively softer than that of the first structural phase and being in contact with at least a portion of the first structural phase.

19. The rock bit as recited in claim 18 wherein each structural unit comprises one or more first structural phase that are separated from one another by a substantially continuous second structural phase.

20. The rock bit as recited in claim 18 wherein the first and second structural phases are each formed from a cermet material selected from the group of carbides, borides and nitrides of the group IVB, VB, VIB, VIIB, and VIII metals and metal alloys of the periodic table.

21. The rock bit as recited in claim 20 wherein the first and second structural phases are each formed from cemented tungsten carbide.

22. The rock bit as recited in claim 21 wherein the cermet material used to form the second structural phase has a higher proportion of metal constituent than the cermet material used to form the first structural phase.

23. The rock bit as recited in claim 21 wherein the cermet material used to form the second structural phase comprises hard grain constituents that are smaller in size than hard grain constituents in the cermet material used to form the first structural phase.

24. The composite construction as recited in claim 18 wherein the first and second structural phases are each formed from polycrystalline diamond.

25. The composite construction as recited in claim 24 wherein both the first and second structural phases include a metal constituent, and wherein the second structural phase comprises a larger proportion of the metal constituent than the first structural phase.

26. A preconsolidated/presintered composite construction comprising:

a first structural phase comprising precursor materials for forming a hard consolidated/sintered material selected from the group consisting of cermets, polycrystalline diamond, and mixtures thereof; and a second structural phase comprising precursor materials for forming a consolidated/sintered material that is relatively softer than the consolidated and sintered first structural phase, the second structural phase being in contact with at least a portion of the first structural phase;

wherein the preconsolidated/presintered composite construction includes repeated structural units that each comprise an ordered microstructure of the first and second structural phases.

27. The preconsolidated/presintered composite construction as recited in claim 26 wherein the repeated structural units comprise two or more first structural phases that are separated from one another by a substantially continuous second structural phase.

28. The preconsolidated/presintered composite construction as recited in claim 26 wherein the first and second structural phases are each formed from different precursor materials.

29. The preconsolidated/presintered composite construction as recited in claim 28 wherein the precursor materials used to form the first structural phase are those that form consolidated and sintered cermet materials selected from the group of carbides, borides and nitrides of the group IVB, VB, VIB, VIIB, and VIII metals and metal alloys of the periodic table.

30. The preconsolidated/presintered composite construction as recited in claim 29 wherein the precursor materials used to form the second structural phase are metals and metal alloys selected from the groups IIIA, IVB, VB, VIB, VIIB, and VIII of the periodic table.

31. The preconsolidated/presintered composite construction as recited in claim 30 wherein the first structural phase is formed from a precursor material used to form cemented tungsten carbide, and the second structural phase is form from cobalt.

32. The preconsolidated/presintered composite construction as recited in claim 26 wherein the first and second structural phases are each formed from the same precursor materials.

33. The preconsolidated/presintered composite construction as recited in claim 32 wherein the precursor materials used to form the first and second structural phases are those that form consolidated and sintered cermet materials selected from the group of carbides, borides and nitrides of the group IVB, VB, VIB, VIIB, and VIII metals and metal alloys of the periodic table.

34. The preconsolidated/presintered composite construction as recited in claim 33 wherein the first and second structural phases are each formed from precursor material used to form consolidated and sintered cemented tungsten carbide.

35. The preconsolidated/presintered composite construction as recited in claim 34 wherein the precursor material used to form the second structural phase has a higher proportion of metal constituent than the precursor material used to form the first structural phase.

36. The preconsolidated/presintered composite construction as recited in claim 34 wherein the precursor material used to form the second structural phase comprises hard grain constituents that are smaller in size than hard grain constituents in the precursor material used to form the first structural phase.

37. The preconsolidated/presintered composite construction as recited in claim 32 wherein the first and second structural phases are each formed from a precursor material used to form consolidated and sintered polycrystalline diamond.

38. The composite construction as recited in claim 37 wherein both the first and second structural phases include a metal constituent, and wherein the second structural phase comprises a larger proportion of the metal constituent than the first structural phase.

39. A method for producing a preconsolidated/presintered composite construction having an ordered material microstructure, the method comprising the steps of:

processing a precursor material used to form a consolidated/sintered material selected from the group consisting of cermets, polycrystalline diamond, and mixtures there into the form of a first structural phase;

processing a precursor material used to form a consolidated/sintered material that is relatively softer than the consolidated/sintered material of the first structural phase into the form of a second structural phase; and combining the first and second structural phases together to form a material microstructure having an ordered arrangement of repeated structural units each formed from the first and second structural phases.

40. The method as recited in claim 39 wherein during the step of combining the first and second structural phases are combined to form structural units each comprising two or more first structural phases that are each separated by a substantially continuous second structural phase.

41. A method for forming a composite construction having an ordered microstructure comprising the steps of:

forming a preconsolidated/presintered green-state composite construction by:

processing a precursor material used to form a consolidated/sintered material selected from the group consisting of cermets, polycrystalline diamond, and mixtures there into the form of a first structural phase;

processing a precursor material used to form a consolidated/sintered material that is relatively softer than the consolidated/sintered material of the first structural phase into the form of a second structural phase;

combining the first and second structural phases together to form a green-state part having a material microstructure with an ordered arrangement of repeated structural units each formed from the first and second structural phases;

consolidating the green-state composite construction at high pressure and at a temperature below a liquification temperature of any of the precursor materials for a determined amount of time to form a consolidated/sintered composite construction having an ordered microstructure.

42. The method as recited in claim 41 wherein the step of consolidating is done by hot isostatic pressing process.

43. The method as recited in claim 41 wherein the step of consolidating is done by rapid omnidirectional compaction process.

44. A method for forming a composite construction having an ordered microstructure comprising the steps of:

forming a preconsolidated/presintered green-state composite construction by:

processing a precursor material used to form a consolidated/sintered material selected from the group consisting of cermets, polycrystalline diamond, and mixtures there into the form of a first structural phase;

processing a precursor material used to form a consolidated/sintered material that is relatively softer than the consolidated/sintered material of the first structural phase into the form of a second structural phase;

combining the first and second structural phases together to form a green-state part having a material microstructure with an ordered arrangement of repeated structural units each formed from the first and second structural phases;

placing the green-state part into a high-temperature ceramic container comprising glass powder disposed therein;

heating the ceramic container to a consolidation temperature above a liquification temperature of the glass powder but below a liquification temperature of the precursor materials; and isostatically pressing the ceramic container within a closed die to produce a consolidated/sintered composite construction comprising the ordered microstructure of the green-state part.

* * * * *